US009789696B2

(12) United States Patent
Paranan et al.

(10) Patent No.: US 9,789,696 B2
(45) **Date of Patent: *Oct. 17, 2017**

(54) FLUID CONTAINER PARTS INCLUDING A LATCH HANDLE AND RIB

(71) Applicant: HEWLETT-PACKARD DEVELOPMENT COMPANY, L.P., Houston, TX (US)

(72) Inventors: Sittampalam Paranan, Singapore (SG); Djuhartini Tandjo, Singapore (SG); Yeang Chyn Wong, Singapore (SG); Lia Wijayanti Pratomo, Singapore (SG); Kiong Chin Chng, Singapore (SG); Boon Huey Yap, Singapore (SG); Soo Leng Teo, Singapore (SG); Ngee Hong Richard Lim, Singapore (SG); Ping Siew Kwok, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/441,625

(22) Filed: Feb. 24, 2017

(65) Prior Publication Data

US 2017/0165976 A1 Jun. 15, 2017

Related U.S. Application Data

(63) Continuation of application No. 14/903,098, filed as application No. PCT/US2013/049886 on Jul. 10, 2013, now Pat. No. 9,616,672.

(51) Int. Cl.
*B41J 2/175* (2006.01)

(52) U.S. Cl.
CPC ..... *B41J 2/17553* (2013.01); *B41J 2/1752* (2013.01)

(58) Field of Classification Search
CPC ..... B41J 2/175; B41J 2/1752; B41J 2/1755; B41J 2/17553; B41J 2/17559
See application file for complete search history.

(56) References Cited

U.S. PATENT DOCUMENTS

| | | | |
|---|---|---|---|
| 6,102,533 | A | 8/2000 | Nozawa et al. |
| 6,155,678 | A | 12/2000 | Komplin et al. |
| 6,302,535 | B1 | 10/2001 | Sturgeon |
| 6,390,601 | B1 | 5/2002 | Morita |
| D469,463 | S | 1/2003 | Yu et al. |
| 6,966,631 | B2 | 11/2005 | Matsuo et al. |
| 7,134,747 | B2 | 11/2006 | Hayashi |

(Continued)

FOREIGN PATENT DOCUMENTS

| | | | |
|---|---|---|---|
| CN | 2925885 | Y | 7/2007 |
| CN | 101117054 | A | 2/2008 |

(Continued)

OTHER PUBLICATIONS

PCT International Search Report and Written Opinion, dated Apr. 23, 2014, PCT Application No. PCT/US2013/049886, Korean Intellectual Property Office, 18 pages.

*Primary Examiner* — Anh T. N. Vo
(74) *Attorney, Agent, or Firm* — HP Inc. Patent Department

(57) ABSTRACT

A part of a fluid container includes a wall and a latch handle connected to the wall through a live hinge. The latch handle slants away from the wall. A rib spans over the hinge and is connected to the latch handle and the wall.

15 Claims, 6 Drawing Sheets

(56) References Cited

U.S. PATENT DOCUMENTS

| | | | |
|---|---|---|---|
| 7,165,829 | B2 | 1/2007 | Hayashi et al. |
| 7,237,881 | B2 | 7/2007 | Hayasaki et al. |
| 7,237,883 | B2 | 7/2007 | Hashii |
| 7,445,323 | B2 | 11/2008 | Anderson, Jr. et al. |
| 7,566,112 | B2 | 7/2009 | Seino |
| 7,601,210 | B2 | 10/2009 | Fujioka et al. |
| 8,002,398 | B2 | 8/2011 | Pearson |
| 8,136,930 | B2 | 3/2012 | Anma |
| 2003/0085967 | A1 | 5/2003 | Ota et al. |
| 2005/0018014 | A1 | 1/2005 | Butty |
| 2005/0151811 | A1 | 7/2005 | Shimizu et al. |
| 2007/0109370 | A1 | 5/2007 | Seino |
| 2008/0018720 | A1 | 1/2008 | Fukushima et al. |
| 2009/0066768 | A1 | 3/2009 | Hashii |

FOREIGN PATENT DOCUMENTS

| | | | |
|---|---|---|---|
| CN | 201151235 | Y | 11/2008 |
| CN | 101549586 | A | 10/2009 |
| CN | 202271661 | U | 6/2012 |
| EP | 2106914 | A1 | 10/2009 |
| JP | 2002120378 | A | 4/2002 |
| JP | 3376299 | | 2/2003 |

FLUID CONTAINER PARTS INCLUDING A LATCH HANDLE AND RIB

CROSS-REFERENCE TO RELATED APPLICATION

This application is a continuation of U.S. application Ser. No. 14/903,098, which is a U.S. National Stage Application of and claims priority to International Patent Application No. PCT/US2013/049886, filed on Jul. 10, 2013, and entitled "FLUID CONTAINER PARTS INCLUDING A LATCH HANDLE AND RIB," which is hereby incorporated by reference in its entirety.

BACKGROUND

Some fluid containers are designed to be inserted and latched to a receiving bay of a fluid dispensing device. Some fluid containers are provided with latch features to facilitate latching to the bay.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of certain elements.

Figure 1:
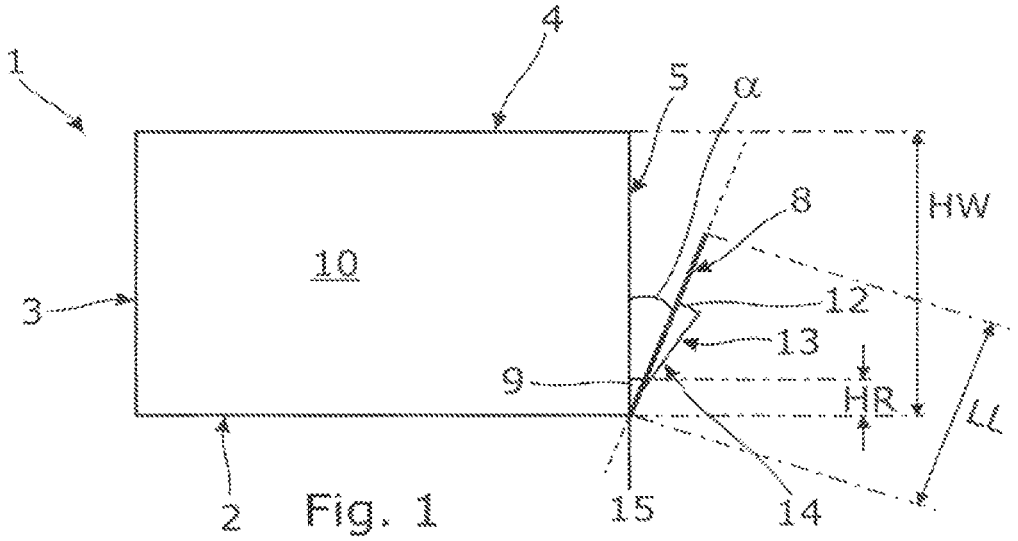
FIG. 1 illustrates an example of a fluid container in side view.
Figure 2:
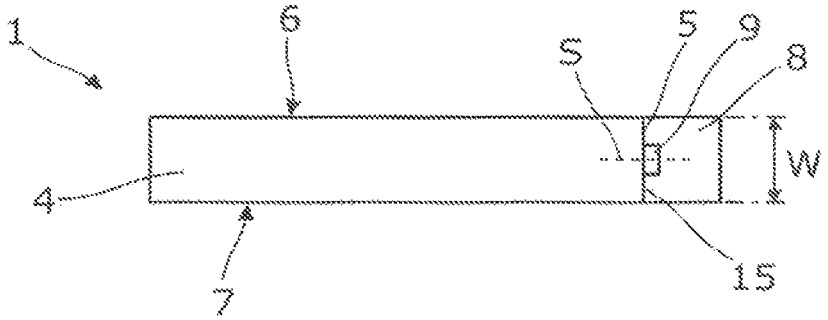
FIG. 2 illustrates an example of a fluid container in top view.

FIG. 1 illustrates an example of a fluid container 1 in side view. FIG. 2 illustrates the example fluid container 1 in top view. The fluid container 1 includes walls 2-7 that enclose an inner volume 10. The inner volume 10 includes fluid such as a liquid such as ink. The inner volume 10 may include a fluid holding device and/or a back pressure device such as a capillary medium. For example the fluid container 1 includes a bottom wall 2, a front wall 3, a top wall 4, a back wall 5 and two side walls 6, 7 for example at approximately straight angles with respect to each other. For example the fluid container 1 and/or each of its outer walls 2-7 have a substantially rectangular shape so that the container 1 has a substantially cuboid shape. For example the fluid container 1 has a relatively thin shape so that the side walls 6, 7 have larger surfaces than the other walls 2-5 that are along the narrower side of the container 1.

For example a fluidic interconnect feature or nozzle is provided in or near the bottom wall 2 to interconnect the fluid container 1 with a receiving bay of a host dispensing device for supplying fluid out of the inner volume 10 to the fluid dispensing device. For example the fluid container 1 is an inkjet cartridge and the host dispensing device is an inkjet printer, the printhead die being an inkjet printhead die. In certain examples the fluid container 1 includes a printhead die that is connected to the inner volume 10 to directly dispense fluid.

The fluid container 1 includes a latch handle 8. For example the latch handle 8 is to lock the fluid container 1 to the receiving bay of the host dispensing device. For example the latch handle 8 is connected to one of the container walls 2-7, in the current example the back wall 5.

In one example a length LL of the latch handle 8 is more than 50% of the height HW of the back wall 5. For example the length LL of the latch handle 8 is at least approximately 65% of the height HW of the back wall 5. In one example the length LL of the latch handle 8 is approximately at least approximately 21 millimeters, for example approximately 38 millimeters, or for example between approximately 10 and 50 millimeters. For example the latch can be approximately 1.4 millimeters thick near its thinnest section and approximately 3.5 millimeters at a latch bump 13.

The example latch handle 8 has a substantially straight, rectangular shape. The example latch handle 8 slants away from the connected wall 5. For example the latch handle 8 has an angle $\alpha$ of between approximately 5 and approximately 50 degrees with respect to the wall 5, for example between approximately 10 and approximately 30 degrees, for example between approximately 15 and 25 degrees, for example approximately 20 degrees.

In the illustrated example the latch handle 8 includes a latch bump 13. In another example the latch handle 8 includes a latch slot. Such latch bump 13 or slot includes a latch surface 12 for engaging a corresponding latch feature of a receiving bay for retaining the container 1 in the receiving bay.

In the illustrated example the latch bump 13 is a protrusion that protrudes out of the outer surface of the latch handle 8, for example in the shape of a hook. The latch bump 13 includes a ramp 14 to allow sliding over a corresponding latch feature of the receiving bay that pushes the latch handle 8 inwards. The latch surface 12 extends at the top of the latch bump 13. Then the latch surface 12 is to engage the latch feature of the receiving bay to retain the fluid container 1 in the receiving bay. In latched condition a fluidic seal between the fluidic interconnects of the container 1 and fluid dispensing device is to be preserved.

The fluid container 1 includes a live hinge 15 to hinge the latch handle 8 with respect to the respective container wall 5. The live hinge 15 connects the latch handle 8 to the wall 5. The live hinge 15 maintains the latch handle 8 in under an angle $\alpha$. For example the live hinge 15 includes a resilient structure to hinge the latch handle 8 back towards the initial inclination, if a force that pushes the latch handle 8 inwards is released. In one example, the latch handle 8 hinges inwards towards the back wall 5 when the ramp 14 slides over a corresponding latch feature a receiving bay, during insertion. The latch handle 8 is to hinge outwards under said resilient force after the latch surface 12 passes the corresponding latch feature so that the latch surface 12 is retained by the latch feature.

In certain circumstances, the fluid container 1 is stored in a packaging during relatively long periods of time, for example during storage, shipment and/or on the shelves. For example, it may be that the container 1 is stored in a vertical orientation wherein the back wall 5 and the latch handle 8 are on the downside of the container 1 (see FIG. 3). In such scenario the latch handle 8 may press against a bottom 30 of the packaging. Examples of filled container 1 weights are between approximately 15 and 300 grams, depending on the size of the container 1 and the fluid quantity it contains. Hence, when stored in the illustrated vertical orientation, the weight of the container 1 pushes on the latch handle 8 and exerts a torque T about the live hinge 15.

Figure 3:
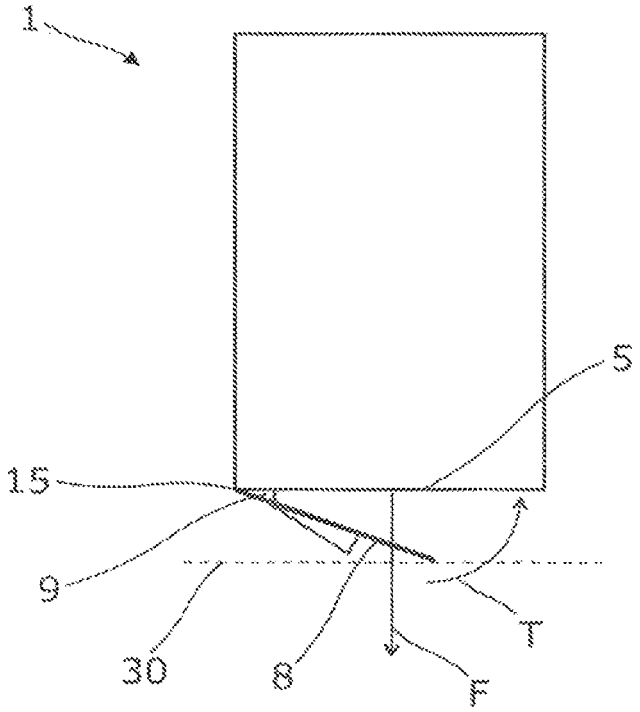
FIG. 3 illustrates an example scenario of an example fluid container during storage in a packaging.

As can be seen from FIGS. 1-3 the fluid container 1 includes a rib 9. The rib 9 is located over the hinge 15 and connected to the latch handle 8 and the wall 5. The rib 9 may be defined by an elevated bump. In different examples the rib 9 can have the shape of a ridge, wedge, pyramid, ramp, bridge, etc. The rib 9 spans over the hinge 15 and is connected to the wall 5 and the latch handle 8. The rib 9 forms an integral part of the back wall 5 and latch handle 8.

For example the rib 9 is to inhibit creep near the hinge 15. For example, the rib 9 may help in retaining the latch handle 8 under the initial angle $\alpha$ and also maintain the resilient properties of the hinge 15, over time. In further examples the rib 9 facilitates a proper latching force and/or resilience of the latch handle 8. In addition to the above, the rib 9 allows for easy and sufficient hinging of the latch handle 8.

In one example a height HR of the rib 9, spanning from the bottom of the live hinge 15 to a highest point of the rib 9, is less than 50% or less than 25% or less than 15% of the length LL of the latch handle 8. In further examples the height HR of the rib 9 is at least 3%, or at least 5% of the length LL of the latch handle 8, as measured from the live hinge 15 upwards. For the example the height HR of the rib 9 is between approximately 0.5 and 15 millimeter, or between approximately 0.5 and 10 millimeter, as measured from the bottom of the hinge 15 up to the highest point of the rib 9.

In one example the rib 9 extends over the middle of the hinge 15. In one example the rib 9 spans over less than 50% of a width W of the hinge 15, for example over approximately 5% to 40% of the width W of the hinge 15.

In one example the rib 9 has a symmetrical shape or mirror symmetrical shape wherein a plane of symmetry S of the rib 9 extends over the middle of the hinge 15. In one example the plane of symmetry S of the rib 9 is perpendicular to the back wall 5 and parallel to the side walls 6, 7 (as seen in FIG. 2).

Figure 4:
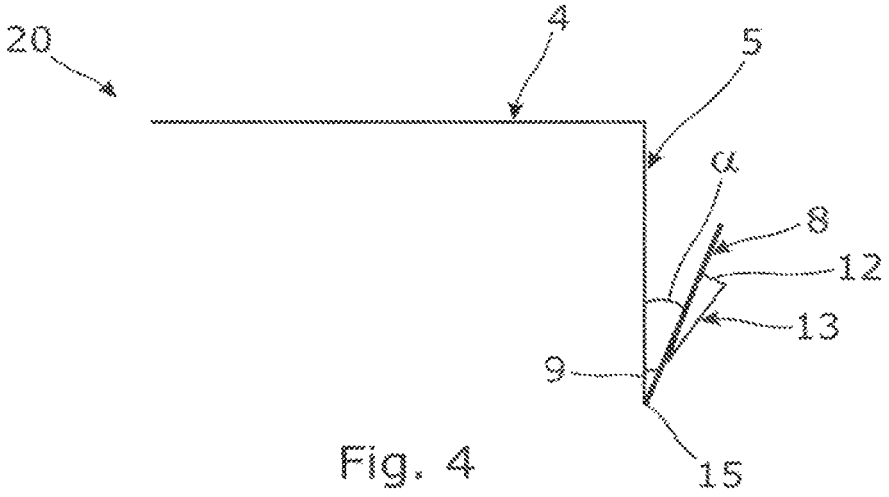
FIG. 4 illustrates an example of a part of the fluid container of FIGS. 1 to 3 in side view.

FIG. 4 illustrates an example of a part 20 of the fluid container 1 of FIGS. 1 and 2. The part 20 includes the wall 5, the live hinge 15, the latch handle 8 and the rib 9. The latch handle 8 and rib 9 are connected near a bottom of the wall 5 through the hinge 15. The part 20 further includes the rib 9 that spans between the handle 8 and the wall 5 and over the hinge 15. The features and relationships between the features are the same as explained with reference to FIGS. 1-3. In one example the part 20 also includes the top wall 4 and can be defined as generally L-shaped.

In one example the part 20 is a single cast, monolithic shape. The part 20 may be molded, for example injection molded, in one injection action within a single mold. In one example the part 20 is to connect to edges of the front, bottom and/or side walls 2, 3, 6, 7 of the container 1 to close the inner volume 10, for example by welding, for example after a capillary medium has been disposed inside. In further examples the top wall 4 and/or part 20 include vent holes, vent labyrinths, spacers, further rib structures, labels, seals, etc.

Figure 5:
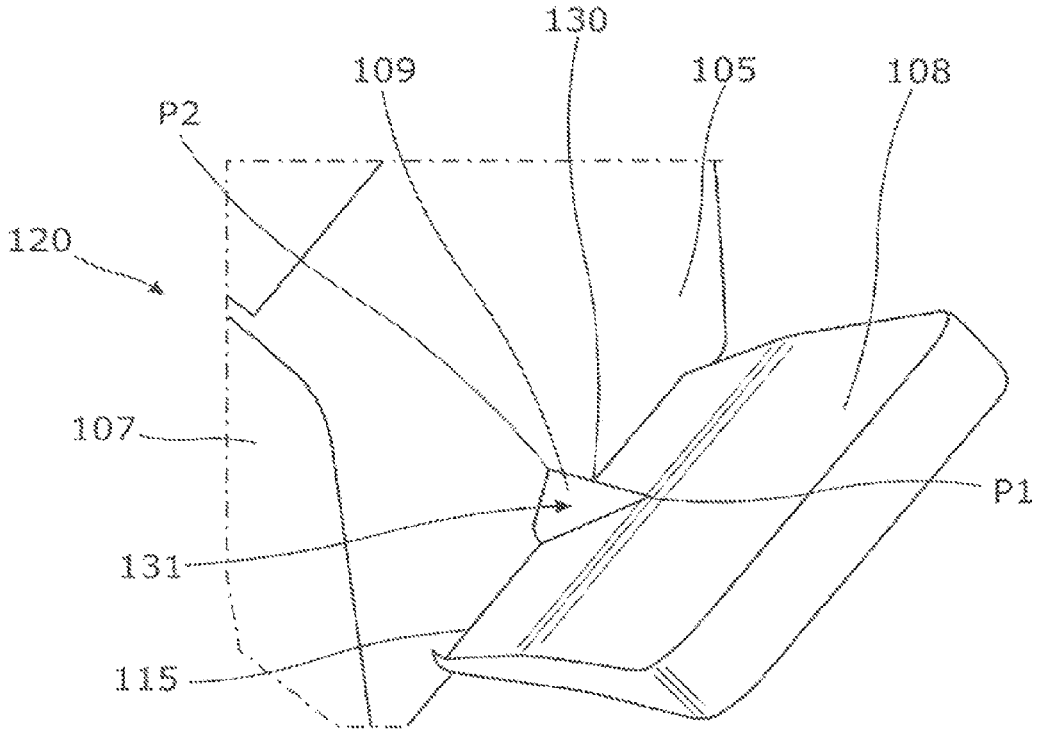
FIG. 5 illustrates an example of a part of a fluid container part in perspective view.
Figure 6:
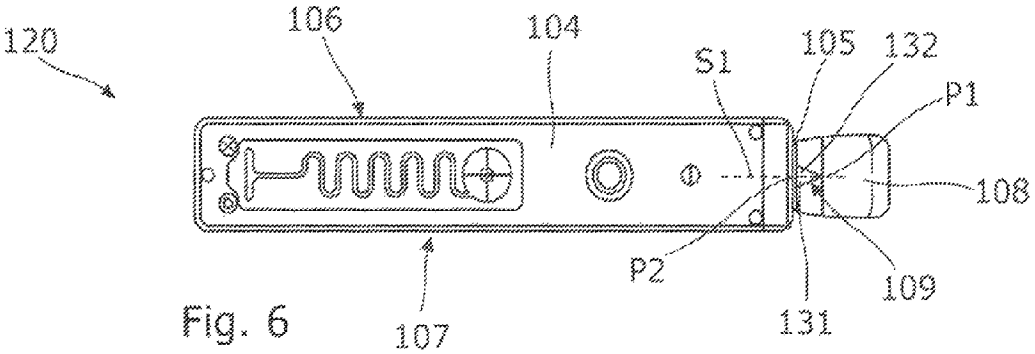
FIG. 6 illustrates the example part of FIG. 5 in top view.
Figure 7:
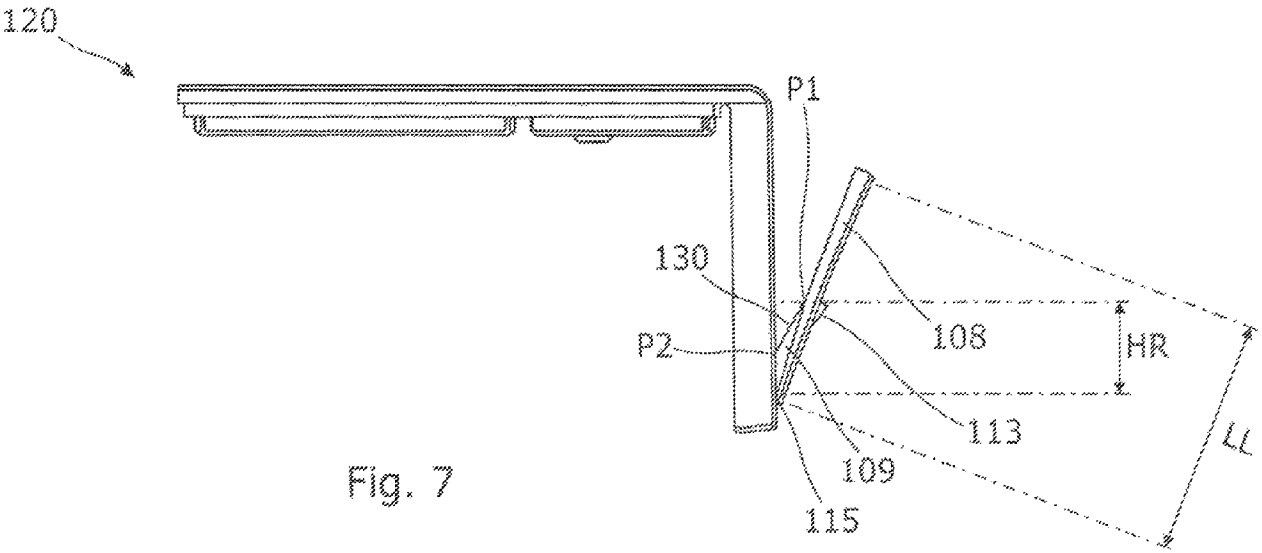
FIG. 7 illustrates the example part of FIGS. 5 and 6 in side view.
Figure 8:
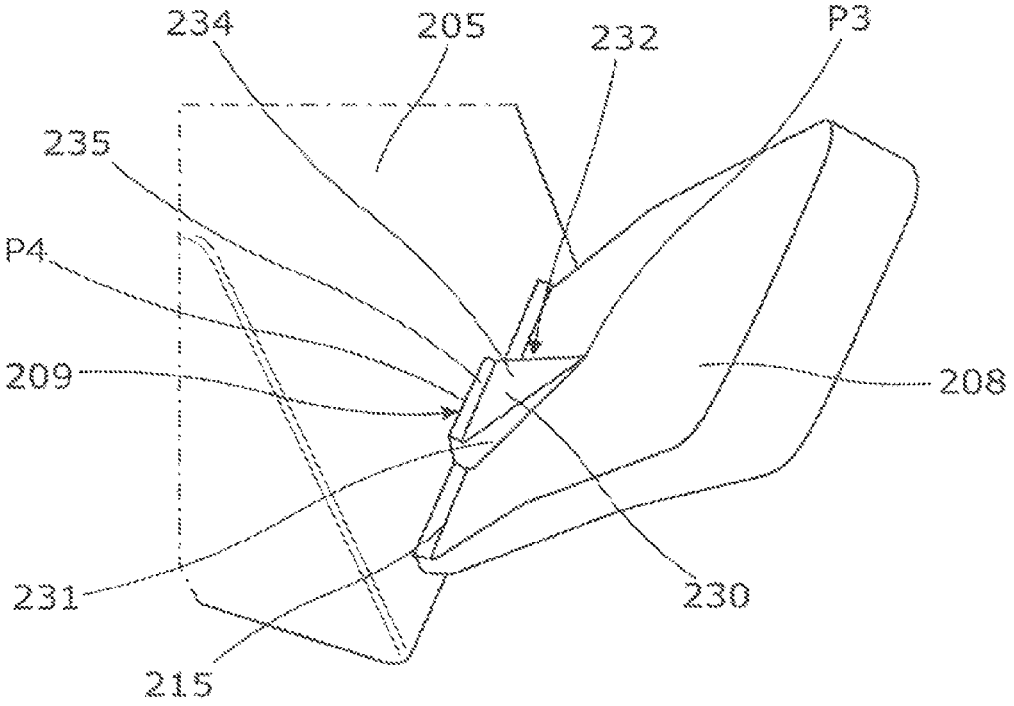
FIG. 8 illustrates another example of a fluid container part in perspective view.
Figure 9:
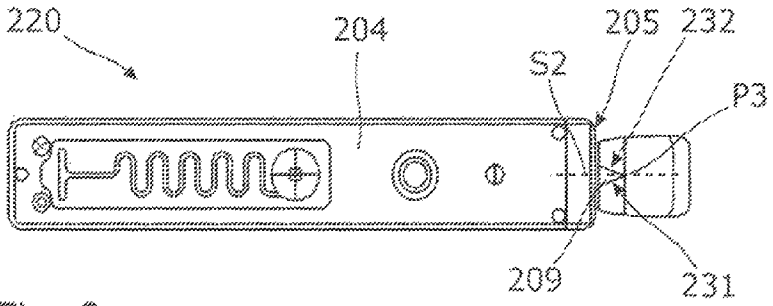
FIG. 9 illustrates the example part of FIG. 8 in top view.
Figure 10:
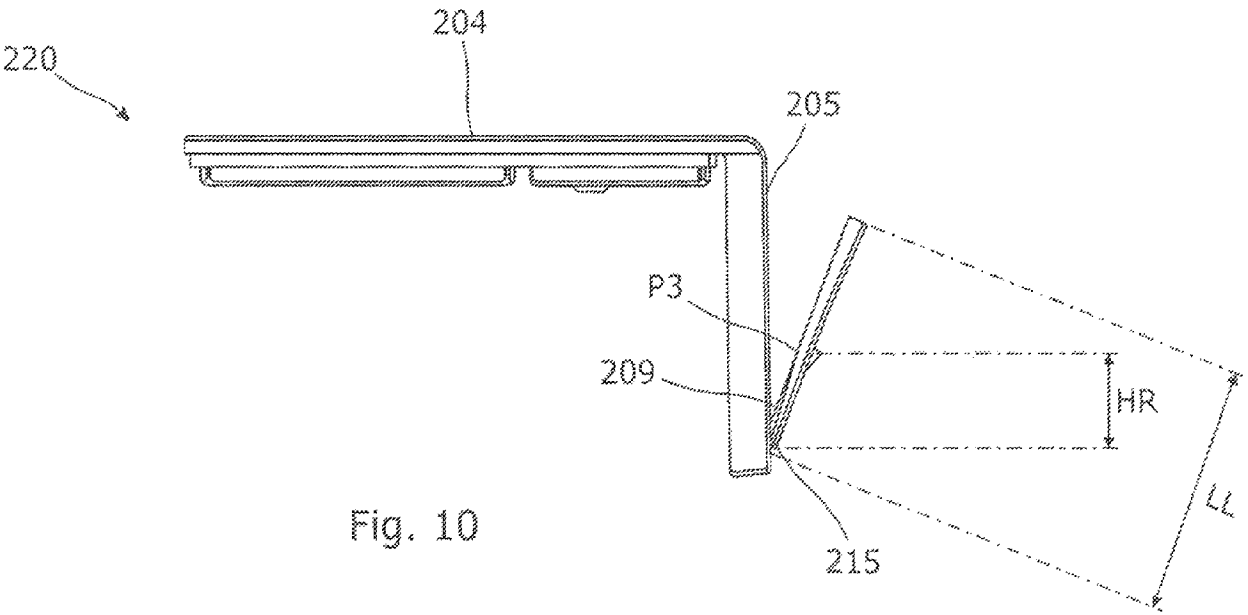
FIG. 10 illustrates the example part of FIGS. 8 and 9 in side view.

FIGS. 5-7 illustrate a first example of a part 120 of a fluid container. FIGS. 8-10 illustrate a second example of a part 220 of a fluid container. The respective parts 120, 220 illustrated in FIGS. 5-7 and 8-10, respectively, are to be connected to walls of a fluid container for enclosing an inner volume, similar to the principle explained above with reference to FIG. 4. The example parts 120, 220 have generally different ribs 109, 209 that will each be described into more detail below.

In the example of FIGS. 5-7, the part 120 has a rib 109. The part 120 includes a back wall 105 and a latch handle 108 protruding from the back wall 105. The latch handle 108 includes a latch bump 113. A live hinge 108 is to hinge the latch handle 108 with respect to the back wall 105. The live hinge 108 may be a film hinge 108. The live hinge 108 spans over almost the entire width of the back wall 105, for example over more than 80% of the back wall 105. The rib 109 lies over at least a middle portion of the live hinge 115.

The rib 109 can be generally pyramid-shaped. For example the pyramid-shape has four triangular surfaces including a base. Two rib-surfaces 131, 132 are exposed, while a third surface lies against the wall back 105 and a fourth surface lies on the latch handle 108. The rib 109 has a top ridge 130 spanning between the latch handle 108 and the wall 105, defined by an intersection line of the two rib-surfaces 131, 132. The top ridge 130 and the rib-surfaces 131, 132 converge into a point P1 on the latch handle 8. For example the top ridge 130 runs along an upwards sloping line, starting from an intersection point P2 on the back wall 105 and terminating in the intersection point P1 on the latch handle 108. The intersection point P1 on the latch handle 108 is higher than the intersection point P2 on the back wall 105. The two rib-surfaces 131, 132 form ramps that intersect on the top ridge 130 and that have borders on the back wall 105 and latch handle 108. The rib 109 may have rounded borders near the latch handle 108 and the back wall 105. Also the top ridge 130 may be rounded.

The rib 109 has a two-symmetrical shape wherein a plane of symmetry S1 of the rib 109 extends over the middle of the hinge 115, the plane of symmetry S1 being perpendicular to the back wall 105 and the top wall 104. The top ridge 130 lies in the plane of symmetry S1 of the rib 109. A cross section of the rib 109 formed by a plane of symmetry S1 may have a generally triangular shape (FIG. 6).

In one example the rib 109 spans over approximately 5 to 50% or 5% to 30% of the width of the live hinge 115. For example the height HR of the rib 109 spans over less than 50% or less than 30% of the length LL of the latch handle 108, as measured from a hinge axis of the live hinge 115 upwards, as seen from a direction perpendicular to the back wall 105.

The example part 220 of FIGS. 8-10 is similar to the part 120 of FIGS. 5-7 except for the rib 209. In FIGS. 8-10 the rib 209 is generally ramp shaped. The rib 209 of FIGS. 8-10 has a top surface 230 spanning between the latch handle 208 and the back wall 205, and rib side-surfaces 231, 232 on each side of the top surface 230, that border on the top surface 230 and the back wall 205 and the latch handle 208. The top surface 230 includes a substantially flat portion 234 that slopes downwards from the latch handle 208 to the back wall 205, up to an upwards curved portion 235 near the back wall 105. The curved portion 235 terminates in the back wall 205 over an intersection line P4 parallel to the live hinge 215.

The side surfaces 231, 232 and the top surface 230 converge into a point P3 on the latch handle 208. The intersection point P3 on the latch handle 208 is higher than the intersection line P4 on the back wall 205. The rib 209 may have rounded borders.

The rib 209 has a two-symmetrical shape wherein a plane of symmetry S2 of the rib 209 extends over the middle of the hinge 215, the plane of symmetry S2 being perpendicular to the back wall 205 and a top wall 204. The intersection point P3 on the latch handle 208 lies in the plane of symmetry S2. A cross section of the rib 209 formed by a plane of symmetry S2 may have a generally triangular shape (FIG. 10), for example with the exception of curved portions near the back wall 205 and/or latch handle 208.

For example the rib 209 spans over approximately 5% to 50% or 5% to 30% of the width of the live hinge 215. For example the height HR of the rib 209 spans over less than 50% or less than 30% of the length LL of the latch handle 208, as measured from a hinge axis of the live hinge 215 upwards, as seen from a direction perpendicular to the back wall 205. For example the height HR of the rib 209 is at least approximately 3% or at least approximately 5% or at least approximately 10% of the height of the latch handle 208.

In one aspect of this disclosure, a fluid container 1 is provided. The fluid container 1 includes walls 2, 3, 4, 5, 6, 7, 104, 105, 204, 205 that enclose an inner volume 10. The fluid container 1 includes a latch handle 8 that slants away from one of the walls 5, 105, 205. The fluid container 1 includes a live hinge 15, 115, 215 that connects the latch handle 8, 108, 208 to the wall 5, 105, 205. The fluid container 1 includes a rib 9, 109, 209 over the hinge 15, 115, 215 that is connected to the latch handle 8, 108, 208 and the wall 5, 105, 205.

For example, the latch handle 8, 108, 208, wall 5, 105, 205, hinge 15, 115, 215 and rib 9, 109, 209 are defined by one monolithic shape. For example, the rib 9, 109, 209 spans over less than 50% of the width W of the hinge 15, 115, 215. For example, the rib 9, 109, 209 spans over the middle of the hinge 15, 115, 215. For example, a plane of symmetry S, S1, S2 of the rib 9, 109, 209 is perpendicular to a back wall 5, 105, 205 and parallel to a side wall 6, 7. For example, a cross section of the rib 9, 109, 209 in the plane of symmetry S, S1, S2 has a substantially triangular shape, a point P1, P3 of the triangular shape terminating on the latch 108, 208.

In one example, the rib 109 is substantially pyramid-shaped, of the kind having four triangular surfaces including a base, one of the surfaces lying on the wall 105 and another surface lying on the latch handle 108. For example the rib 109 has a top ridge 130 spanning between the latch handle 108 and the wall 105. For example, the rib top ridge 130 is substantially straight and slopes upwards towards and terminating in a point P1 on the latch handle 108.

In another example, the rib 209 has a ramp-shaped top surface 230 spanning between the latch handle 208 and the wall 205. For example near the wall 205 the top surface 230 curves upwards, forming a curved portion 235, and terminates in the wall 205 along a line P4. For example, the top surface 230 converges into a point P3 on the latch handle 208.

In further examples, the length LL of the latch handle 8, 108, 208 is more than 50% of the height HW of the wall 5, 105, 205. In again further examples, the latch handle 8, 108, 208 has an extended, rectangular shape, and in an unlatched condition the latch handle 8, 108, 208 has a relatively stable inclination a of between approximately 5 degrees and approximately 50 degrees with respect to the wall 5, 105, 205.

In one aspect of this disclosure, a monolithic fluid container part 20, 120, 220 is provided. The part 20, 120, 220 includes a wall 5, 105, 205. A hingeable latch handle 8, 108, 208 is connected near a bottom of the wall 5, 105, 205 through a live hinge 15, 115, 215. The latch handle 8, 108, 208 slants away from the wall 5, 105, 205. A rib 9, 109, 209 lies over the hinge 15, 115, 215 spanning from the latch handle 8, 108, 208 to the wall 5, 105, 205 to inhibit creep near the live hinge 15, 115, 215 caused by a container weight F during storage.

What is claimed is:

1. A fluid container comprising:

a number of walls enclosing an inner volume;

a latch handle slanting away from a first wall among the number of walls;

a live hinge connecting the latch handle to the first wall; and a rib connecting the latch handle to the first wall;

wherein the rib is pyramid-shaped having four triangular surfaces with the base of the pyramid-shaped rib coupled to the surface of the first wall and a first side of the pyramid-shaped rib coupled to a surface of the latch handle.

2. The fluid container of claim 1, wherein the latch handle is thinner near the live hinge than at a distal end of the latch handle.

3. The fluid container of claim 1, wherein the latch handle, wall, hinge and pyramid-shaped rib are defined by one monolithic shape.

4. The fluid container of claim 1, wherein the pyramid-shaped rib spans over less than 50% of the width of the hinge.

5. The fluid container of claim 1; wherein the pyramid-shaped rib spans over the middle of the hinge.

6. The fluid container of claim 1, wherein a plane of symmetry of the pyramid-shaped rib is perpendicular to a back wall and parallel to a side wall of the container and wherein a cross section of the pyramid-shaped rib in the plane of symmetry has a substantially triangular shape with a point of the triangular shape connected to the latch, another point lying on the wall and another point lying on the hinge.

7. The fluid container of claim 1, wherein the pyramid-shaped rib has a top ridge spanning between the latch handle and the wall.

8. The fluid container of claim 1, wherein the pyramid-shaped rib top ridge is substantially straight, slopes upwards and away from the hinge and wall towards the latch handle, and terminates in a point on the latch handle.

9. The fluid container of claim 8, wherein the side surfaces of the pyramid shaped rib converge into a point on the latch handle.

10. The fluid container of claim 1, wherein the length of the latch handle is more than 50% of the height of the wall.

11. The fluid container of claim 1, wherein the latch handle has an extended, rectangular shape, and in an unlatched condition the latch handle has a relatively stable inclination of between approximately 5 and approximately 50 degrees with respect to the wall.

12. A monolithic fluid container part, comprising:

a wall;

a hingeable latch handle connected to the wall through a live hinge, the latch handle slanting away from the wall; and a rib lying over the hinge spanning from the latch handle to the wall;

wherein the rib is pyramid-shaped having four triangular surfaces with the base of the pyramid-shaped rib coupled to the surface of the first wall and a first side of the pyramid-shaped rib coupled to a surface of the latch handle.

13. The monolithic fluid container part of claim 12, wherein the latch handle is thinner near the live hinge than at a distal end of the latch handle.

14. An inkjet cartridge, comprising:

a pyramid-shaped rib spanning over a live hinge formed between at least one wall of the inkjet cartridge and a latch handle:

wherein the pyramid-shaped rib comprises four triangular surfaces with the base of the pyramid-shaped rib coupled to the surface of the first wall and a first side of the pyramid-shaped rib coupled to a surface of the latch handle.

15. The inkjet cartridge of claim 14, wherein the latch handle is thinner near the live hinge than at a distal end of the latch handle.

* * * * *